United States Patent [19]

Shea

[11] Patent Number: 4,954,003

[45] Date of Patent: Sep. 4, 1990

[54] COUPON ORGANIZER

[76] Inventor: Patrick A. Shea, 736 NE. Capital Blvd., Salt Lake City, Utah 84103

[21] Appl. No.: 428,065

[22] Filed: Oct. 30, 1989

[51] Int. Cl.[5] ..... B42F 13/00

[52] U.S. Cl. ..... 402/079; 281/2; 281/31; 281/38; 283/63.1

[58] Field of Search ..... 402/79; 283/56, 55, 283/36, 42, 63.1; 281/15.1, 38, 42, 31; 40/159; 206/309, 311, 312

[56] References Cited

U.S. PATENT DOCUMENTS

| | | | |
|---|---|---|---|
| 1,574,838 | 3/1926 | Moore | 402/79 |
| 1,683,479 | 9/1928 | Nystrom | 206/311 |
| 2,677,376 | 5/1954 | Brunner | 402/79 |
| 3,208,772 | 9/1965 | Dahlstrand et al. | 283/63.1 |
| 4,055,008 | 10/1977 | Bell | 281/31 |
| 4,419,837 | 12/1983 | Meeker | 281/38 |
| 4,508,366 | 4/1985 | Brindle | 281/2 |
| 4,704,042 | 11/1987 | Eisen et al. | 206/312 |
| 4,784,264 | 11/1988 | Sykes | 206/312 |
| 4,824,273 | 4/1989 | Silva et al. | 402/79 |

FOREIGN PATENT DOCUMENTS

| | | | |
|---|---|---|---|
| 2553342 | 4/1985 | France | 402/79 |

*Primary Examiner*—Frank T. Yost
*Assistant Examiner*—Hwei-Siu Payer
*Attorney, Agent, or Firm*—Jon C. Christiansen

[57] ABSTRACT

A coupon organizer for organizing and holding coupons for shopping items. The coupon organizer has a plurality of coupon holding pockets and a plurality of aisle cards. An aisle card is used to record shopping items. The coupon holding pockets are used to hold coupons for the shopping items recorded on the aisle cards. The coupon organizer can also include a store map and a shopping list.

20 Claims, 5 Drawing Sheets

COUPON ORGANIZER

INTRODUCTION

This invention relates to a coupon organizer that can be used to plan for shopping and to organize coupons which can be used to purchase shopping items.

Coupons offering discounts, rebates, savings and/or other benefits are widely available to consumers. Coupons are available for a wide variety of many different products and services. To shop effectively with coupons, and to realize the significant savings and other benefits of coupons, it is necessary to organize coupons and to match them with the shopping items (i.e. products and services) needed or desired by the consumer. It is an objective of this invention to provide a coupon organizer which can facilitate the accomplishment of these objectives.

It is a further objective of this invention to assist consumers in organizing and planning for shopping before leaving home. These objectives and other objectives, advantages and aspects of the invention are described in the descriptions and drawings of this disclosure.

SUMMARY OF THE INVENTION

The invention coupon organizer has a plurality of aisle cards and a plurality of coupon holding means. Each aisle card is a means for recording shopping items found in a store aisle (or other store area). A coupon holding means can be a pocket or other means for holding coupons for the shopping items of an aisle card. Thus, aisle cards and coupon holding means can be paired together. The aisle cards and coupon holding means are held by a primary holding means such as a binder or other holding means.

The aisle cards and coupon holding means can be positioned and held in the primary holding means in such a manner that each aisle card and coupons in the coupon holding means paired with the aisle card can be viewed together. This allows the user to easily determine what coupons he or she has for the shopping items recorded on the aisle card. Preferably, the aisle cards and coupon holding means are positioned in the primary holding means in an alternating order (e.g. first coupon holding means, first aisle card, second coupon holding means, second aisle card, etc.). This alternating order can begin with either a coupon holding means or an aisle card.

The coupon holding means can be a pocket. Preferably, the pocket includes a transparent surface (i.e. a transparent surface area) through which coupons in the pocket can be viewed. An aisle card can be held in an aisle card holding means such as, but not limited to, a leaf with an aisle card pocket. Preferably, the aisle card pocket includes a transparent surface through which the aisle card can be viewed.

The coupon organizer can also include a store map onto which store information can be recorded. The coupon organizer can further include a shopping list and/or a pocket for miscellaneous coupons or a calculator.

DETAILED DESCRIPTION OF INVENTION

Figure 1:
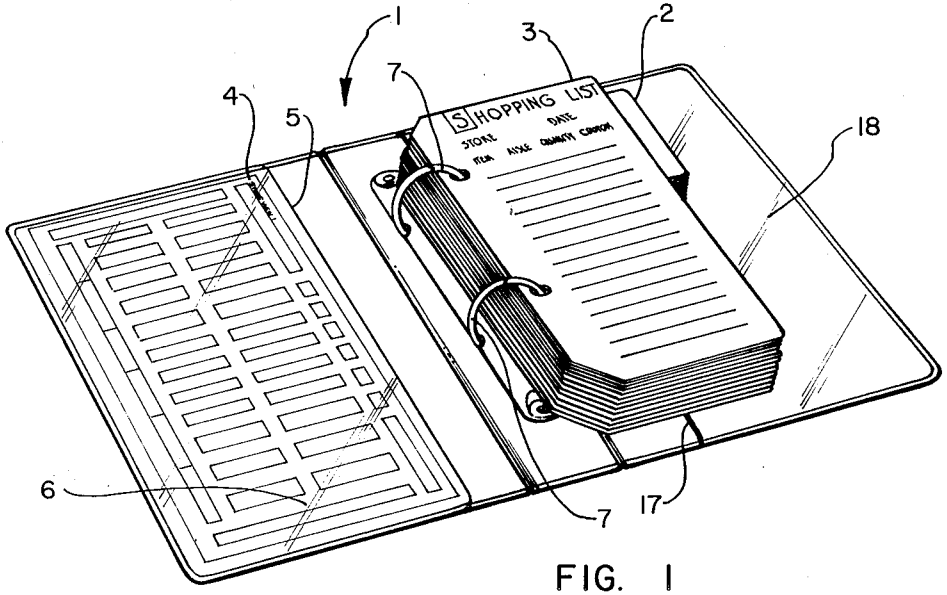
FIG. 1 depicts an embodiment of the inventive coupon organizer showing a store map and a shopping list.
Figure 2:
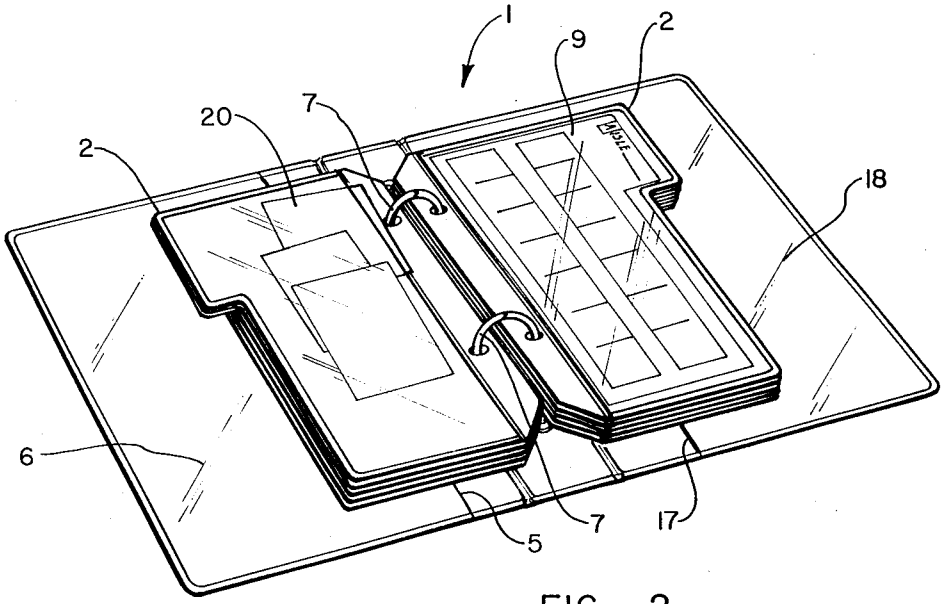
FIG. 2 depicts an embodiment of the inventive coupon organizer showing the back side of a leaf with a pocket for coupons and the front side of a leaf with a pocket for an aisle card.

An embodiment of the inventive coupon organizer is shown in FIGS. 1, 2, 3, 4, 5, 6 and 7. FIGS. 1 and 2 show a two-ring binder 1 which serves as a means for holding leaves 2, shopping list 3 and store map 4. Other means can be used to hold the leaves (and shopping list and store map) but a binder is preferred. For example, the leaves (and shopping list and store map) can be bound together in any manner that books, brochures or other textual materials are bound. Binder 1 is only one example of a primary holding means.

Binder 1 includes on its inside cover a pocket 5 for holding store map 4. Pocket 5 includes a transparent surface 6 to allow the user to view store map 4. Binder 1 can, in alternative embodiments of the invention, employ other means for holding a store map. For example, the store map can be clipped, stapled, glued or otherwise secured to the binder (preferably, but not necessarily, to the inside front cover of the binder). The store map can also be drawn or printed on the binder (e.g. on the inside binder cover) itself. The store map can also be secured to the binder through rings 7 or through another securing means. All of the foregoing are examples of how the binder can hold a store map.

Figure 3:
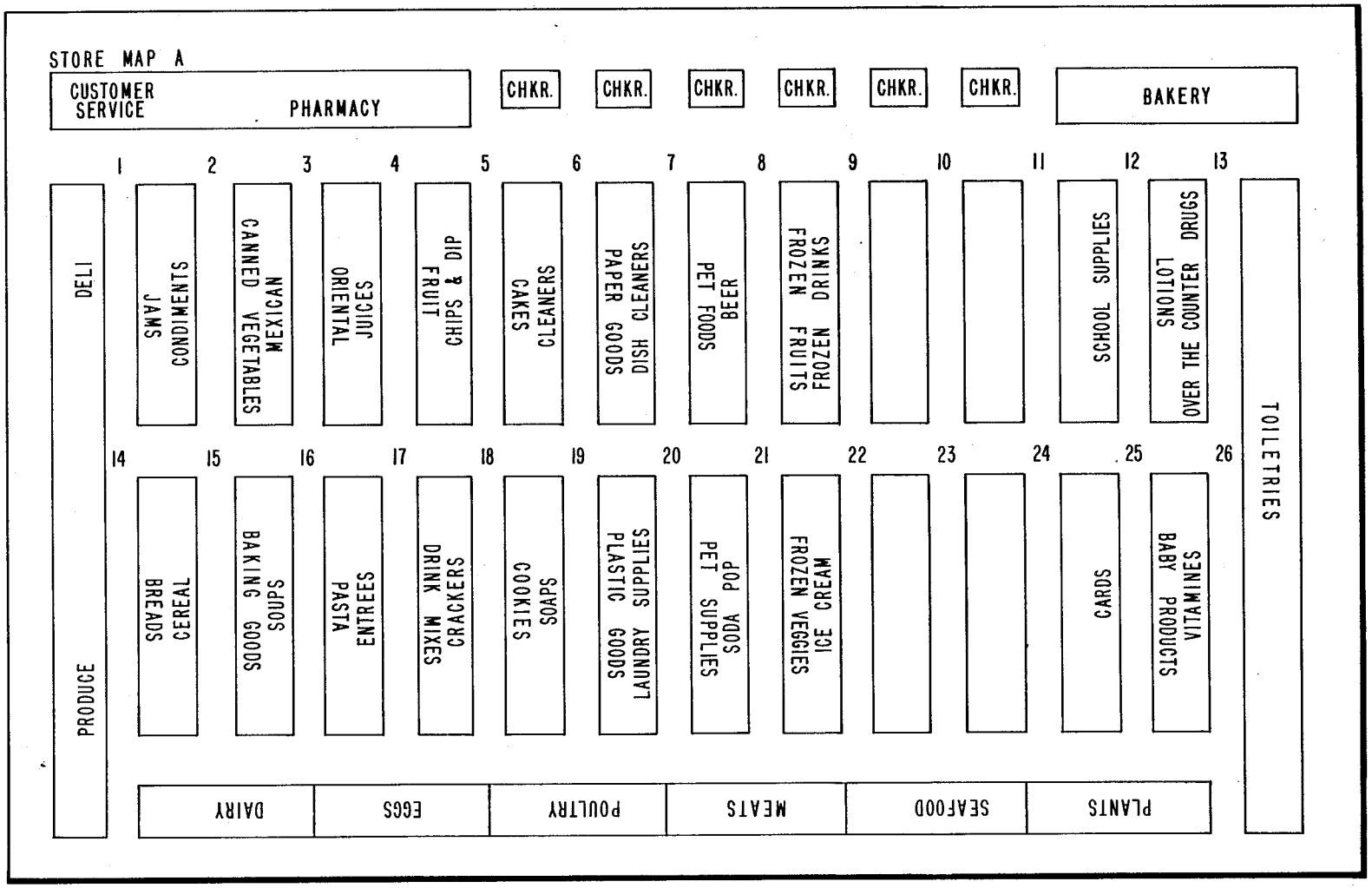
FIG. 3 depicts a store may onto which store information has been recorded.
Figure 4:
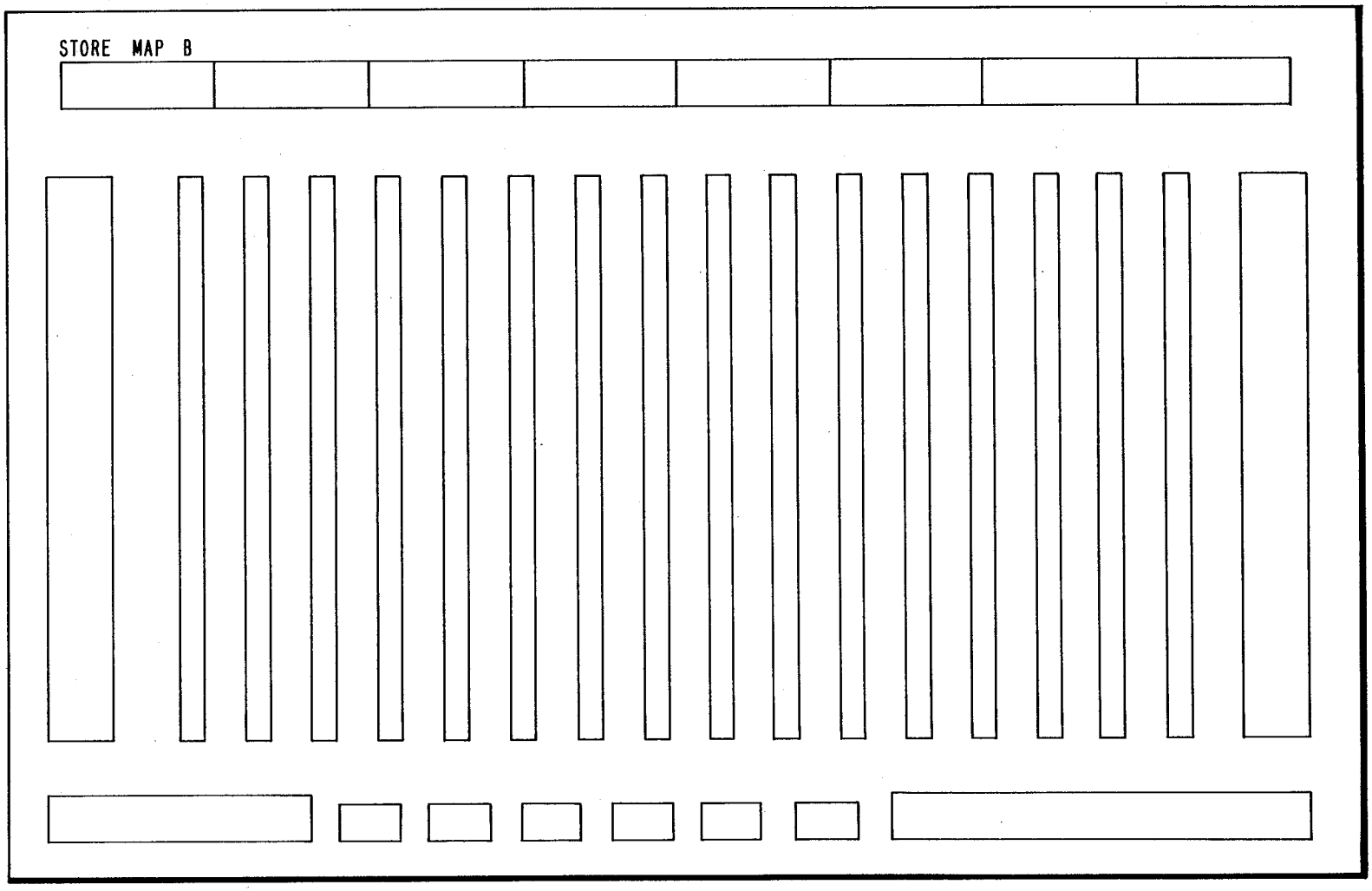
FIGS. 4 and 5 depict other store maps.
Figure 5:
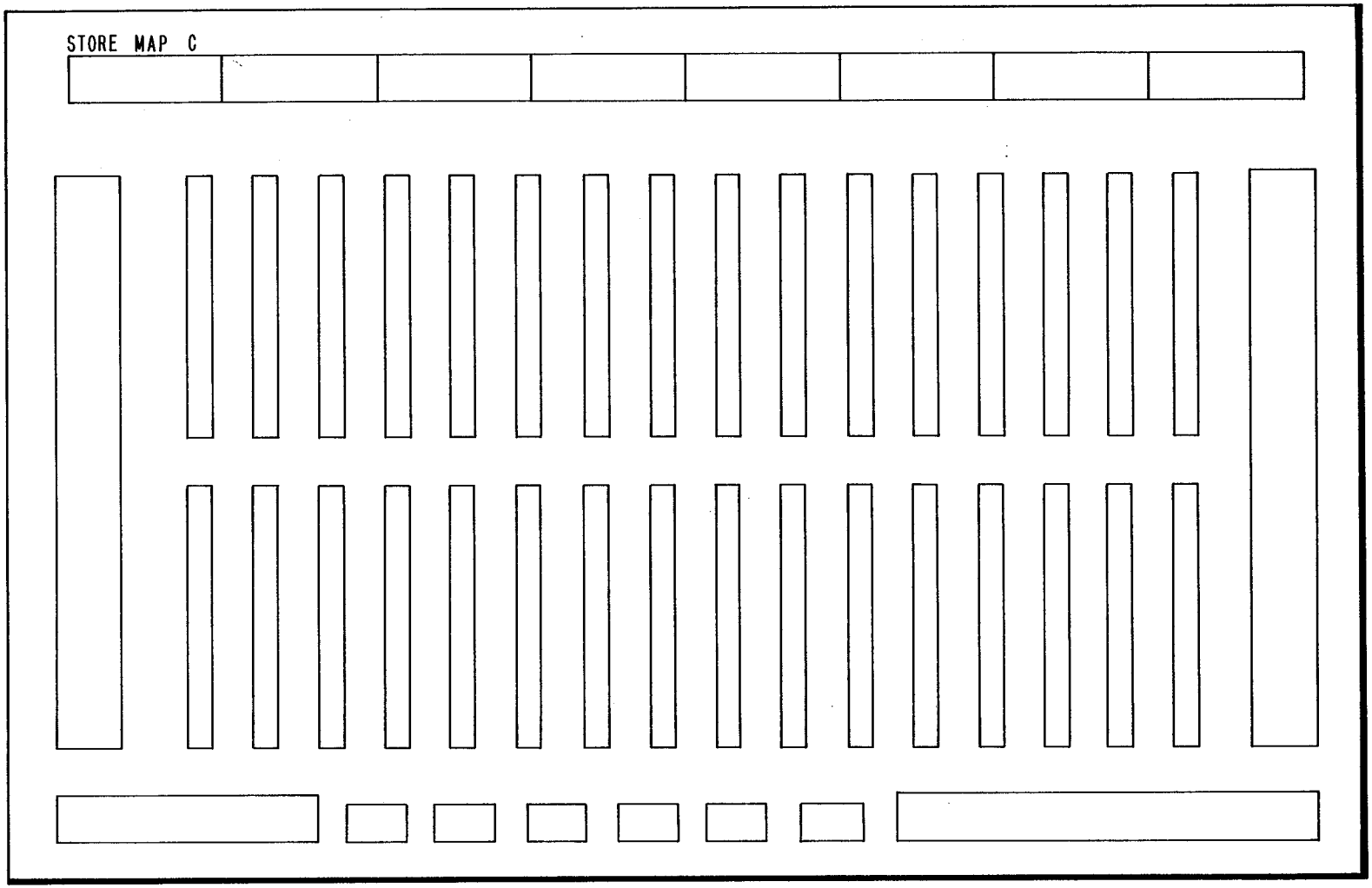

The store map 4 can be selected from plurality of store maps. FIGS. 3, 4 and 5 depict sample store maps. The user of the coupon organizer can select from these store maps, the store map which most closely represents the store at which the user desires to shop. A store map can be any map, diagram or drawing which represents the layout or physical organization of a store. The store maps are initially in a generic or blank form (e.g. FIGS. 4 and 5). The selected store map can be completed or filled-in with store information as shown in FIG. 3. Store information is information which identifies store products or services (e.g. food items, toiletries, plants, supplies, etc.).

The store map of FIG. 3 has each store aisle labeled with a number. Aisles are numbered from 1 to 26. Other aisles or store areas can also be numbered or identified if desired. For example, the aisle from plants to dairy and the pharmacy area can also each be numbered as an aisle. Each aisle (or other store area) is marked to indicated the shopping items found in that aisle (or store area). For example, aisle 2 has condiments on one aisle side and canned vegetables on the other aisle side. It is not necessary to record store information on the store map that is not of interest to the user.

Figure 6:
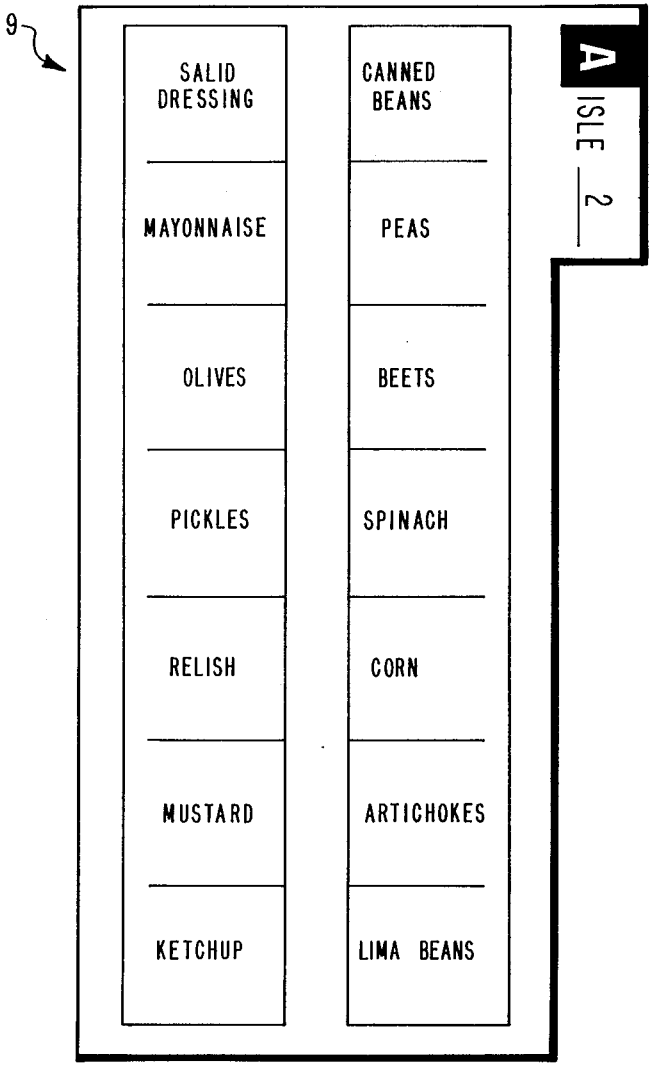
FIG. 6 depicts an aisle card that has been used to record shopping items found in an aisle of a store.

For each aisle (or store area) of interest to the user, an aisle card 9 (see FIG. 6) is completed or filled-in. The aisle card contains more specific store information applicable to the aisle (i.e. shopping items found in the aisle are recorded on the aisle card). For example, FIG. 6 shows an aisle card for aisle 2 of the store map of FIG. 3. The condiments are more specifically identified on the left side of the aisle 2 card. The canned vegetables are more specifically identified on the right side of the aisle 2 card. The shopping items of interest to the user which are found in aisle 2 are recorded on the aisle card for aisle 2. Aisle 2 shopping items that are not of interest to the user do not need to be recorded. If desired, a single aisle card can be used to record shopping items for more than one aisle (or store area).

Figure 7:
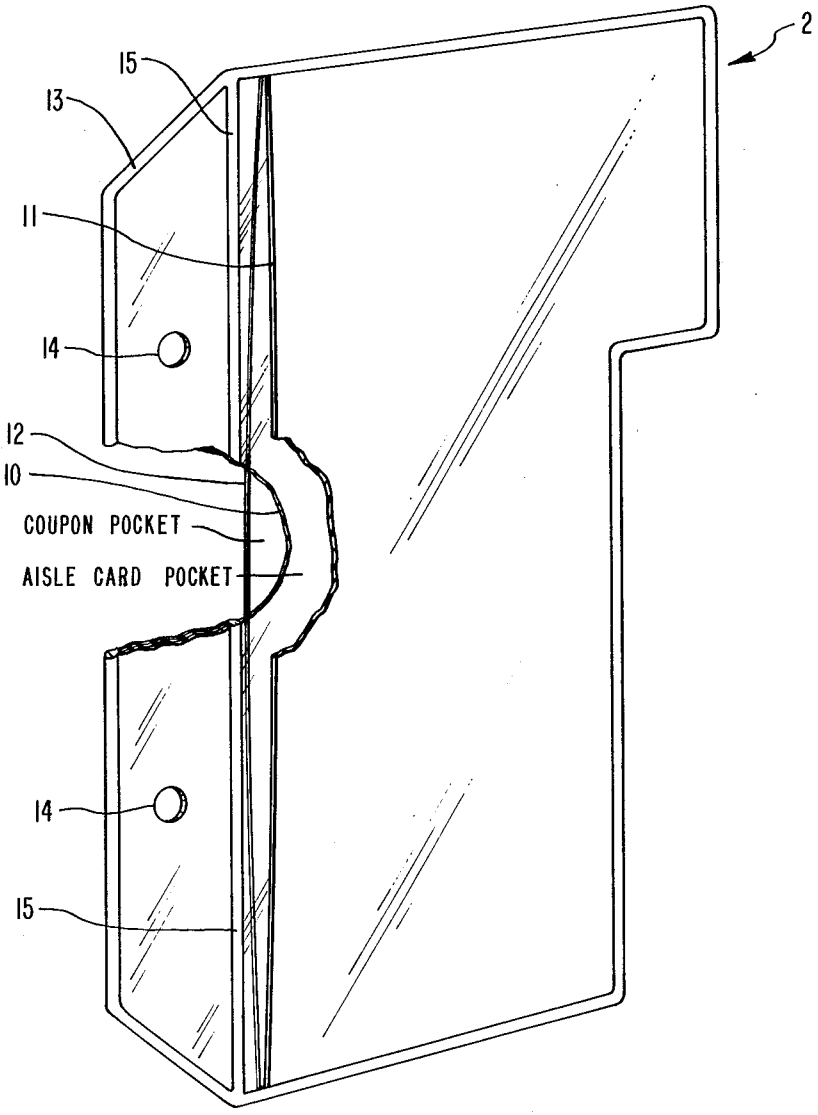
FIG. 7 depicts a leaf, including a coupon pocket for holding coupons and an aisle card pocket for holding an aisle card.

FIG. 2 depicts a plurality of leaves 2 which are held by binder 1. An individual leaf is shown in FIG. 7. Each leaf includes a pocket on each side of the center piece 10 of the leaf. Center piece 10 is a sheet of plastic to which layers 11 and 12 have been heat sealed. An aisle card pocket is formed by transparent layer or surface 11 and center piece 10. A coupon pocket is formed by transparent layer or surface 12 and center piece 10. A hinge 13 having holes 14 serves as a means for securing the leaf to binder 1 through rings 7. Hinge 13 is hinged along line 15 as shown in FIG. 7 to facilitate the turning of leaves 2 in binder 1.

The aisle card pocket is a means for holding an aisle card. Thus, the leaf can function as a means for holding an aisle card. The aisle card can be inserted into the aisle card pocket through the pocket opening near hinge 13. Because layer 11 is made of a transparent material (e.g. a transparent plastic that has been heat sealed to center piece 10), the aisle card can be viewed. In alternative embodiments of this invention, the aisle card can be held by the leaf through means other than a pocket (e.g. clip, staple, adhesive, etc.) or can be held directly by the binder 1 (e.g. through holes in the aisle card that are compatible with rings 7).

The coupon pocket serves as a means for holding coupons. The coupons can be inserted into the coupons pocket through the pocket opening near hinge 13. Because layer 12 is made of a transparent material (e.g. a transparent plastic that has been heat sealed to center piece 10), the coupons 20 can be easily viewed. In alternative embodiments of this invention, the coupon pocket can be replaced by other means for holding coupons (e.g. clips, staples, adhesives, etc. ).

Each leaf 2 has a coupon pocket on one face of the leaf and an aisle card pocket on the opposite face of the leaf. As seen in FIG. 2, the leaves 2 are positioned and held in binder 1 in such a manner that each coupon pocket is paired with an aisle card. The coupon pocket of one leaf is paired with the aisle card of the next leaf. The coupon pocket of one leaf holds coupons 20 for shopping items recorded on aisle card 9 held in the aisle card pocket of the next leaf. Thus, when the coupon organizer is opened to a given aisle card (e.g. aisle card 2), the coupons for shopping items recorded on the aisle card can be viewed together with the aisle card. FIG. 2 illustrates how coupons and an aisle card can be viewed together. The aisle cards and coupon pockets are positioned and held in binder 1 such that for each aisle card, the coupons for the aisle card's shopping items and the aisle card can be viewed together. The user needs only to turn to the desired aisle card to view the coupons and aisle card together.

Note that in this embodiment of the invention, the first leaf need only have a coupon pocket on the back face of the leaf and the last leaf need only have an aisle card pocket (and aisle card) on the front face of the leaf. Intermediate leaves have both an aisle card pocket (and aisle card) on the front face and a coupon pocket on the back face. Coupon pockets and aisle cards are positioned in binder 1 in an alternating sequence. This allows the coupon pocket of one leaf to be paired with the aisle card of the next leaf.

The user of the invention coupon organizer can organizer coupons at home prior to shopping. Coupons for shopping items if each given aisle are placed into the coupon pocket paired with the aisle card for the aisle. At the store, the user will be able to reference shopping items to available coupons.

The coupon organizer can also include a shopping list 3. The shopping list is used to record shopping items that are desired or needed by the user. The shopping list includes a column to record the aisle in which the item may be found and a column to indicate whether or not there is a coupon for the item. Shopping list 3 is held by binder 1 through rings 7. The shopping list facilitates planning and preparation for shopping before leaving home for the store.

The coupon organizer can also include a pocket 17 for holding miscellaneous coupons (e.g. automotive coupons, fast food restaurant coupons, etc.) or for holding a calculator. Pocket 17 has a transparent layer or surface 18 that allows the contents (e.g. coupons or calculator) of pocket 17 to be viewed. Pocket 17 is formed by heat sealing a transparent plastic layer 18 to the inside cover of binder 1.

Conventional materials and methods of manufacture well known as persons of ordinary skill in the art can be used to make the inventive coupon organizer. Conventional transparent plastic sheets are presently preferred for construction of the leaves. A sturdy paper or cardboard is presently preferred for the aisle cards, store maps and shopping. Unconventional and future materials and methods of manufacture may also be used to make the inventive coupon organizer without departing from the scope of this invention or the appended claims.

The foregoing description of my invention so fully reveals the general nature of the invention that others can readily modify such description or invention and/or adapt it for various applications without departing from its general concept, and, therefore such adaptations and modifications should be and are intended to be comprehended within the meaning and range of equivalents of the following claims, which claims define subject matter regarded by me to be my invention.

I claim:

1. A coupon organizer comprising:

(a) a first aisle card, (b) a second aisle card, (c) a first coupon holding means for holding coupons, (d) a second coupon holding means for holding coupons, and (e) a primary holding means for holding said first aisle card, said second aisle card, said first coupon holding means and said second coupon holding means;

wherein each of said aisle cards comprises a representation of at least one shopping aisle;

wherein each of said aisle cards can be used to record shopping items found in at least one shopping aisle of a store;

wherein said first coupon holding means can be used to hold coupons for shopping items recorded on said first aisle card; and wherein said second coupon holding means can be used to hold coupons for shopping items recorded on said second aisle card.

2. A coupon organizer in accordance with claim 1 wherein said first aisle card and said first coupon holding means are positioned and held in said primary holding means in such a manner that said first aisle card and coupons in said first coupon holding means can be viewed together; and wherein said second aisle card and said second coupon holding means are positioned and held in said primary holding means in such a manner that said second aisle card and coupons in said second coupon holding means can be viewed together.

3. A coupon organizer in accordance with claim 2 wherein said first coupon holding means is a pocket for holding coupons; and wherein said second coupon holding means is a pocket for holding coupons.

4. A coupon organizer in accordance with claim 3 wherein each of said coupon holding pockets has a transparent surface to allow coupons in the pocket to be viewed.

5. A coupon organizer in accordance with claim 2 further comprising a store map for recording store information; and wherein said store map comprises a representation of the shopping aisles represented by said aisle cards.

6. A coupon organizer in accordance with claim 5 further comprising a pocket for holding said store map.

7. A coupon organizer in accordance with claim 2 further comprising a shopping list for recording shopping items; and wherein said primary holding means also holds said shopping list.

8. A coupon organizer in accordance with claim 2 further comprising a pocket for holding miscellaneous coupons.

9. A coupon organizer in accordance with claim 2 wherein said primary holding means comprises a binder with rings to hold said aisle cards and said coupon holding means.

10. A coupon organizer in accordance with claim 9 wherein said coupon organizer further comprises a first aisle card holding means for holding said first aisle card and a second aisle card holding means for holding said second aisle card; and wheren said first aisle card holding means and said second aisle card holding means are held by said rings.

11. A coupon organizer in accordance with claim 2 further comprising:

(f) a third aisle card, and (g) a third coupon holding means for holding coupons;

wherein said primary holding means also holds said third aisle card and said third coupon holding means;

wherein said third aisle card comprises a representation of at least one shopping aisle;

wherein said third aisle card can be used to record shopping items found in at least one shopping aisle of a store;

wherein said third coupon holding means can be used to hold coupons for shopping items recorded on said third aisle card; and wherein said third aisle card and said third coupon holding means are positioned and held in said primary holding means in such a manner that said third aisle card and coupons in said third coupon holding means can be viewed together.

12. A coupon organizer comprising a plurality of leaves and a leaf holding means for holding said plurality of leaves;

wherein said plurality of leaves comprising a first leaf, a second leaf and a third leaf;

wherein said first leaf comprises a coupon holding means for holding coupons;

wherein said second leaf comprises an aisle card, a means for holding said aisle card and a coupon holding means for holding coupons;

wherein said third leaf comprises an aisle card and a means for holding said aisle card;

wherein each of said aisle cards comprises a representation of at least one shopping aisle;

wherein each of said aisle cards can be used to record shopping items found in at least one aisle of a store; and wherein said leaves are positioned and held in said leaf holding means in such a manner that: (i) the aisle card of said second leaf and coupons in the coupon holding means of said first leaf can be viewed together, and (ii) the aisle card of said third leaf and coupons in the coupon holding means of said second leaf can be viewed together.

13. A coupon organizer in accordance with claim 12 wherein the coupon holding means of said first leaf comprises a pocket for holding coupons;

wherein the coupon holding means of said second leaf comprises a pocket for holding coupons; and wherein each of said coupon holding pockets has a transparent surface so that coupons in the pocket can be viewed.

14. A coupon organizer in accordance with claim 13 wherein the aisle card holding means of said second leaf comprises a pocket for holding an aisle card;

wherein the aisle card holding means of said third leaf comprises a pocket for holding an aisle card; and wherein each of said aisle card holding pockets has a transparent surface so that an aisle card in the pocket can be viewed.

15. A coupon organizer in accordance with claim 14 wherein said plurality of leaves further comprises a fourth leaf;

wherein said fourth leaf comprises an aisle card and a pocket for holding said aisle card;

wherein the aisle card of said fourth leaf comprises a representation of at least one shopping aisle;

wherein the aisle card of the fourth leaf can be used to record shopping items found in at least one aisle of a store;

wherein said third leaf further comprises a coupon holding pocket for holding coupons;

wherein the pocket of said fourth leaf has a transparent surface so that an aisle card in said pocket can be viewed;

wherein said coupon holding pocket of said third leaf has a transparent surface so that coupons in said pocket can be viewed; and wherein said fourth leaf is positioned and held in said leaf holding means in such a manner that the aisle card of said fourth leaf and coupons in the coupon holding pocket of said third leaf can be viewed together.

16. A coupon organizer in accordance with claim 15 further comprising a store map for recording store information;

wherein said store map comprises a representation of the shopping aisles represented by said aisle cards; and wherein said leaf holding means further comprises a means for holding said store map.

17. A coupon organizer in accordance with claim 16 wherein said means for holding said store map is a pocket;

wherein said store map pocket has a transparent surface to allow said store map to be viewed.

18. A coupon organizer in accordance with claim 17 further comprising a shopping list for recording shopping items;

wherein said leaf holding means further comprises a means for holding said shopping list.

19. A coupon organizer comprising a plurality of leaves and a means for holding said leaves;

wherein each of said leaves comprises a coupon pocket on one face of the leaf and an aisle card pocket on the opposite face of the leaf;

wherein said coupon pocket can be used to hold coupons;

wherein each of said leaves further comprises an aisle card held in the aisle card pocket of the leaf;

wherein each of said aisle cards comprises a representation of at least one shopping aisle;

wherein each of said aisle cards can be used to record shopping items found in at least one aisle of a store; and wherein each aisle card pocket is paired with a coupon pocket in such a manner that coupons in said coupon pocket and the aisle card in said aisle card pocket can be viewed together.

20. A coupon organizer in accordance with claim 19 wherein each of said coupon pockets has a transparent face to allow coupons in the pocket to be viewed; and wherein each of said aisle card pockets has a transparent face to allow the aisle card in the pocket to be viewed.

* * * * *